US007147128B1

(12) United States Patent
Verrault et al.

(10) Patent No.: US 7,147,128 B1
(45) Date of Patent: Dec. 12, 2006

(54) DISPENSING BOX FOR PAPER TOWELS

(76) Inventors: Richard Verrault, 6527 boul. St. Jacques, Neufchatrel, Quebec (CA) G2C 1M3; Alain Jacques, 2287 Kennedy Road, Scott, Quebec (CA) G0S 3G0

( * ) Notice: Subject to any disclaimer, the term of this patent is extended or adjusted under 35 U.S.C. 154(b) by 0 days.

(21) Appl. No.: 09/787,782

(22) PCT Filed: Sep. 21, 1999

(86) PCT No.: PCT/CA99/00849

§ 371 (c)(1),
(2), (4) Date: Nov. 13, 2002

(87) PCT Pub. No.: WO00/16678

PCT Pub. Date: Mar. 30, 2000

(30) Foreign Application Priority Data

Sep. 21, 1998 (CA) ..... 2248503

(51) Int. Cl.
*B65H 1/00* (2006.01)

(52) U.S. Cl. ..... 221/34; 221/46; 221/63

(58) Field of Classification Search ..... 221/33, 221/34, 45, 46, 49, 63, 92, 93, 94; 206/449, 206/494, 812
See application file for complete search history.

(56) References Cited

U.S. PATENT DOCUMENTS

| | | | | |
|---|---|---|---|---|
| 4,535,912 A * | 8/1985 | Bonk | ..... | 221/46 |
| 5,322,178 A * | 6/1994 | Foos | ..... | 220/326 |
| 5,553,712 A * | 9/1996 | Tisbo et al. | ..... | 206/752 |
| 6,540,084 B1 * | 4/2003 | Silvers | ..... | 206/581 |

FOREIGN PATENT DOCUMENTS

GB 1449265 * 9/1976

* cited by examiner

*Primary Examiner*—David H. Bollinger
(74) *Attorney, Agent, or Firm*—McHale & Slavin PA

(57) ABSTRACT

This invention concerns a dispensing box for paper towels comprising a container and a cover linked by a strap hinge to the container. A retractable inner box inverted in the container defines a section for receiving a stack of towels. The inner box has a base and an elongated opening arranged in the base for removing the towels therethrough. The cover opening and the towel passage through the elongated opening enables the towels stored in a chamber with controlled atmosphere to be pulled out for use. The section can be divided into two chanbers, one moistened and one dry, by a partition to provide two types of towels for use. A cover storage can also be installed inside the cover.

6 Claims, 5 Drawing Sheets

DISPENSING BOX FOR PAPER TOWELS

SCOPE OF THE INVENTION

This invention is related to the domain of plastic cases, and in particular to those which may contain stacks of dry or moist towelettes, especially towelettes to which cleansing solutions are added, for example for glasses, hands, eye shades, monitor screens, or cosmetic solutions which may contain cosmetic oils, cleansing milk, or absorbent or paper towelettes.

PRIOR ART

Certain patents have especially attracted our attention:

FR 2233020; Cordi; January 1975, shows folded moist towelettes in a double-walled container.

U.S. Pat. No. 5,219,092; Moraud; Jun. 15, 1993; shows interleaved towelettes supported in small packets.

DE Switzerland 259082; outer cover with lid

U.S. Pat. No. 5,622,281; folded paper dispenser

U.S. Pat. No. 3,994,417; moistened towelettes in a container to be supported on a base which has a roll of paper.

U.S. Pat. No. 3,172,564; Enloe; Mar. 9, 1965, reveals a method for rolling paper to be folded.

EP 157628; corrugations keep the sheets aligned.

OBJECTIVES AND ADVANTAGES

A general object of the invention is to provide a portable container which may hold two stacks of towelettes: one moist, the other dry. More particularly, a watertight and hinged box which comprises a container and a lid, with an inner removable box which has two compartments.

IN THE DRAWINGS

With respect to the drawings that illustrate an embodiment of the invention

DESCRIPTION OF THE INVENTION

Figure 1:
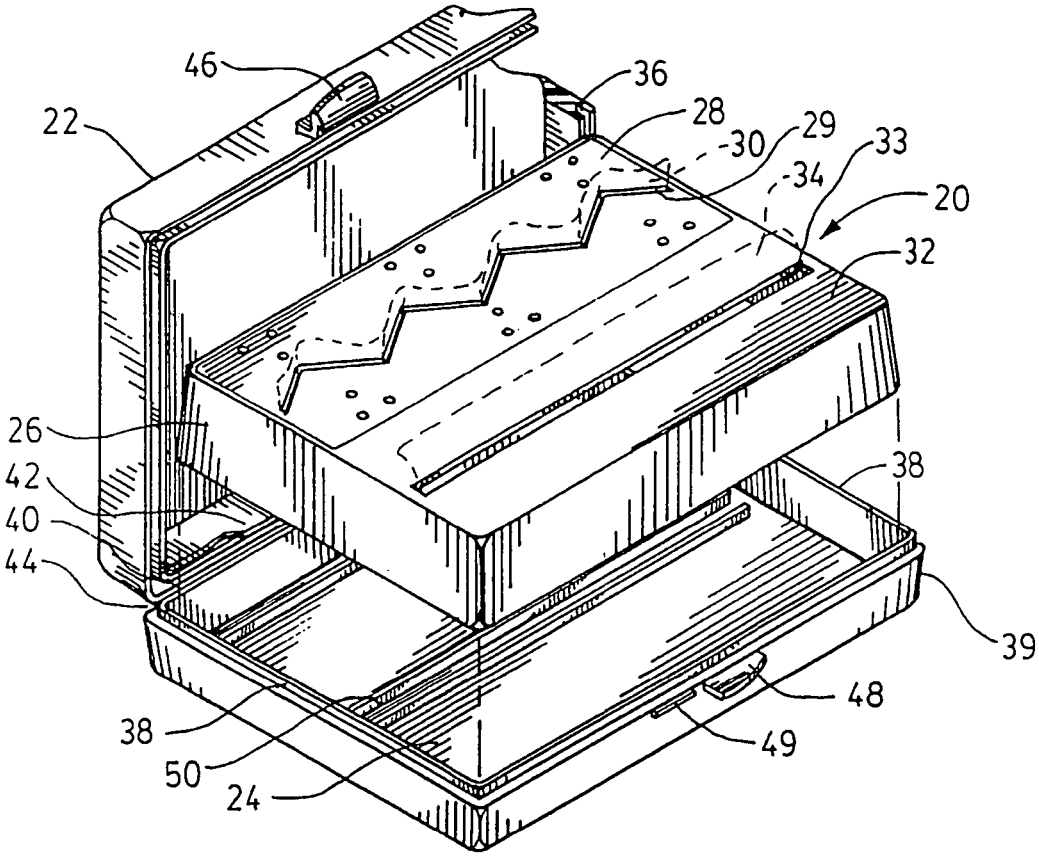
FIG. 1 is an exploded view of a case for towelettes for cleaning glasses

In the description that follows and in the drawings that accompany it, like numbers refer to identical parts in the various figures.

FIG. 1 represents an open plastic dispenser 20, a sort of case, which has a lid 22 which may be closed over a container 24. An inner box 26 which has a moist chamber 28 which dispenses a stack of moist towelettes 30, shown in dotted lines, through a serrated opening 29 and a dry chamber 32 which dispenses a stack of dry towelettes 34, shown in dotted lines, through a straight opening 33. A female perimeter 36 makes possible the watertightness of the device through its adjustment to a male perimeter 38. Rounded corners 39 are present on the perimeter. A hinge 40 is at the back as well as a tab 42 that connects to a cavity 44. On the center front, a lid fastener 46 may fasten onto a container fastener 48 through a fastener latch 49. In order to make possible greater solidity and watertightness, low central walls 50 are placed in parallel in order to hold a partition 52 (FIG. 2.).

Figure 2:
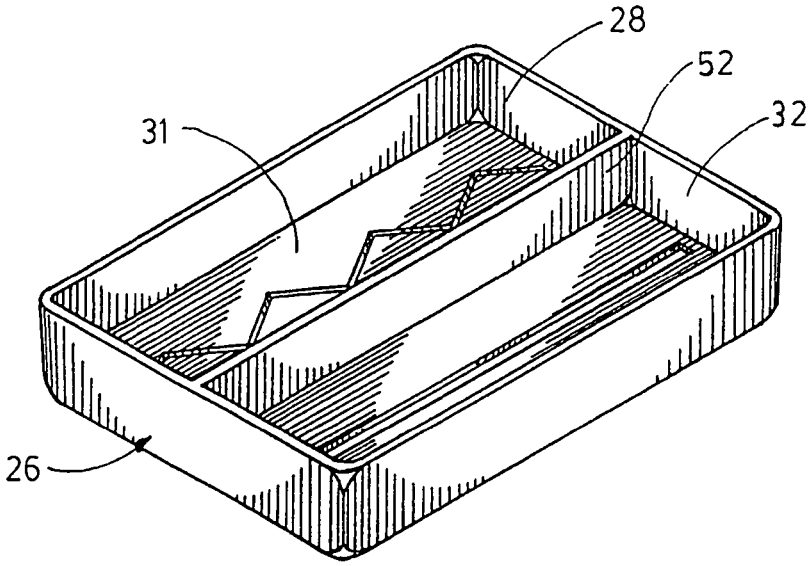
FIG. 2 is a view of the inside of a compartment of the case.

FIG. 2 shows the inner box 26 divided by the partition 52 into two separate chambers: the moist chamber 28 and the dry chamber 32. A bottom 31, where the serrated or straight openings are located, is also shown.

Figure 3:
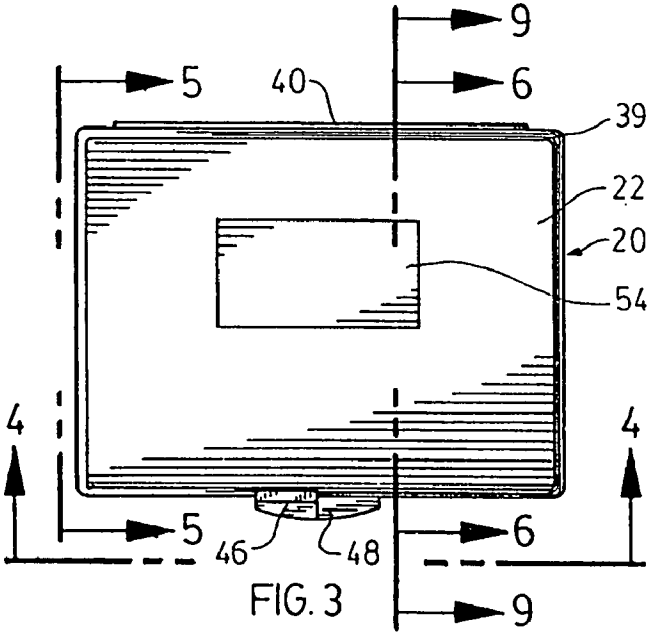
FIG. 3 is a top plan view of the case.

FIG. 3 shows the lid 22 and its corners 39 in plan. At the back is the hinge 40 and at the front the lid fastener 46 and the container fastener 48. A rectangular identification cavity 54 is placed on the upper surface.

Figure 4:
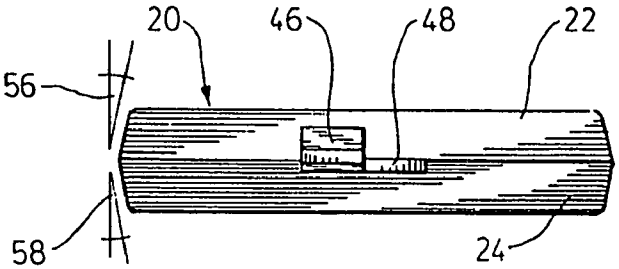
FIG. 4 is a front view of the case in FIG. 3.
Figure 5:
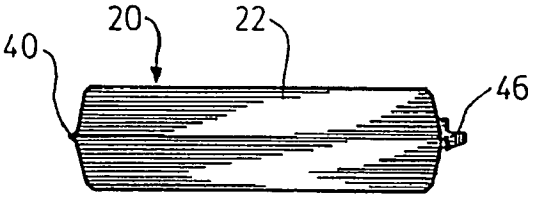
FIG. 5 is a side view of the case in FIG. 3.

FIG. 4 shows the case 20, the lid 22, and the container 24 with two narrowed areas on the perimeter which define a lid angle 56 toward the top and a container angle 58 toward the bottom FIG. 5 shows the case from the side, in closed position, so as to show the bend of the hinge 40.

Figure 6:
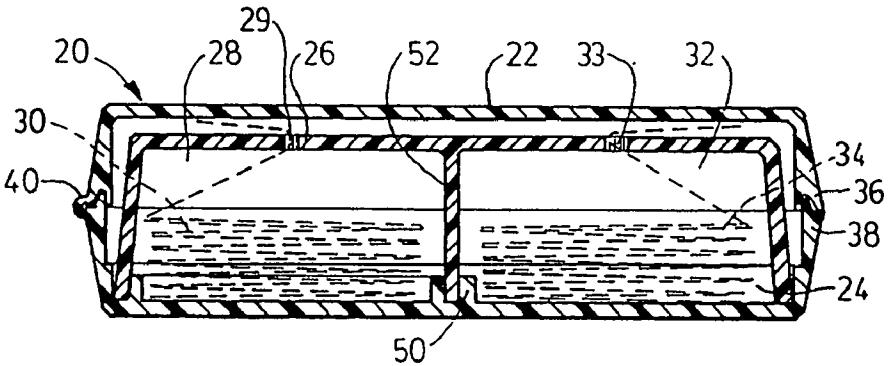
FIG. 6 is a cross section of the case in FIG. 3.

FIG. 6 shows the inside of the case 20 in cross section. The recess of the inverted inner box 26 is in the container 24. In the moist chamber 28, the serrated opening 29 makes it possible to dispense the moist towelettes 30. Concurrently, the straight opening 33 is located in the dry chamber 32 for the passage of the dry towelettes 34. The recess of the female perimeter 36 around the male perimeter 38, which makes watertightness possible, is noted. The hinge 40 also acts in the same sense. The introduction of the partition 52 into the low central walls 50 is also noted.

Figure 7:
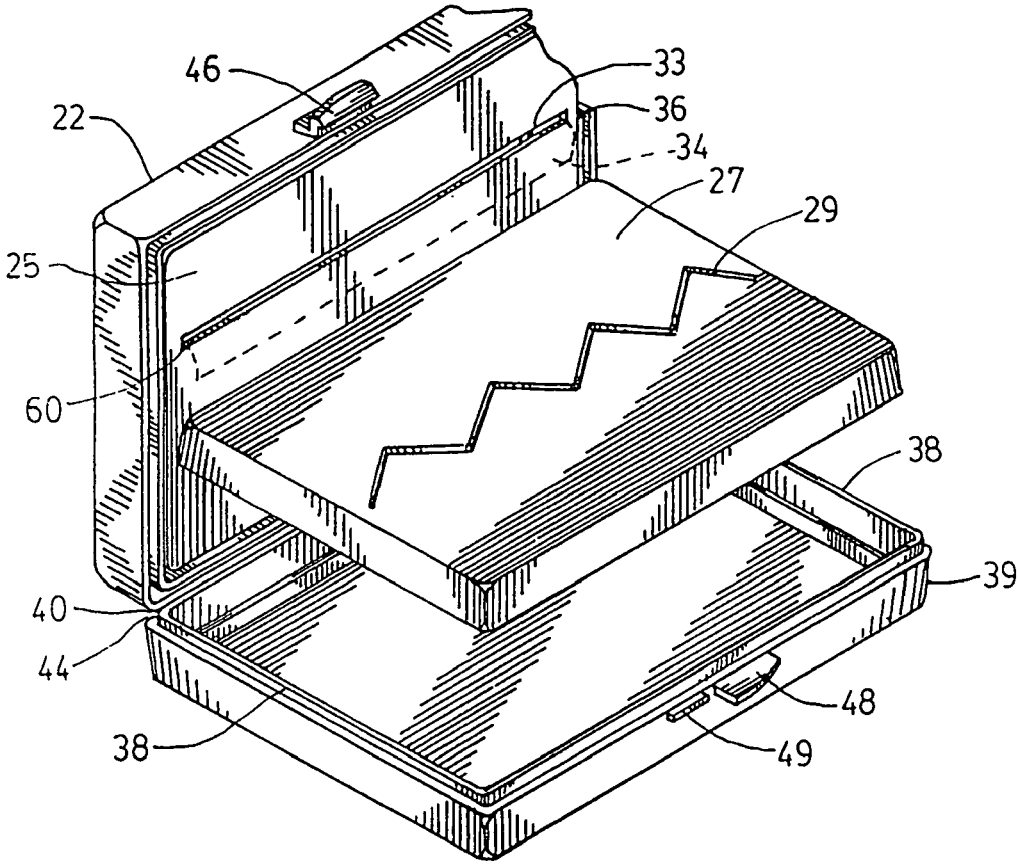
FIG. 7 is a view of an alternate embodiment.

FIG. 7 shows a lid compartment 25 made thinner in the lid 22, as well as a compartment 27, also made thinner, in the container. Each of the compartments has an opening: a serrated opening 29 in the compartment 27, and an elongated opening 60, preferably straight, in the lid compartment 25.

Figure 8:
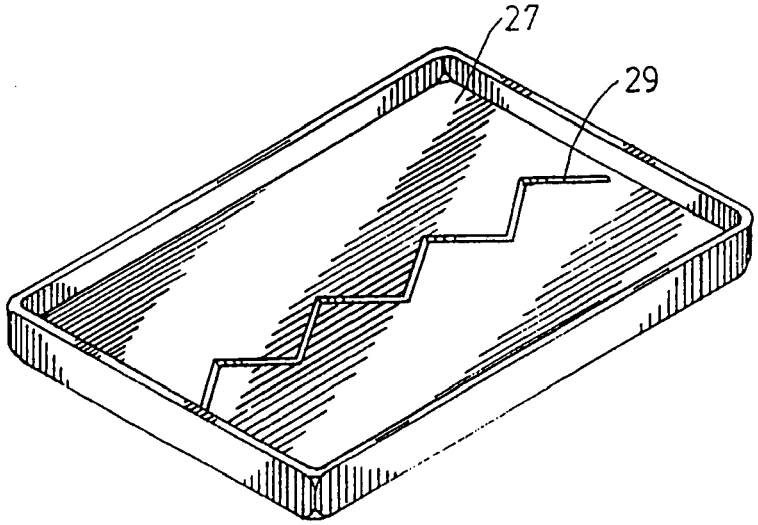
FIG. 8 is a view of the outside of the alternate embodiment.

FIG. 8 shows the serrated opening 29 which makes it possible to remove the moist towelettes placed centrally in the compartment 27 which serves as the container compartment.

Figure 9:
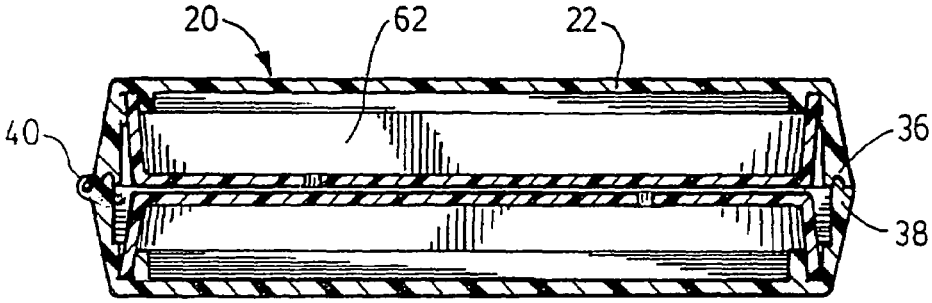
FIG. 9 is a section of the alternate embodiment.

FIG. 9 shows the female perimeter 36 around the lid 22 and the male perimeter 38 which fits into it. The lid compartment and the compartment, which define two reversible cartridges 62 hinged to the hinge 40, are also shown.

Figure 10:
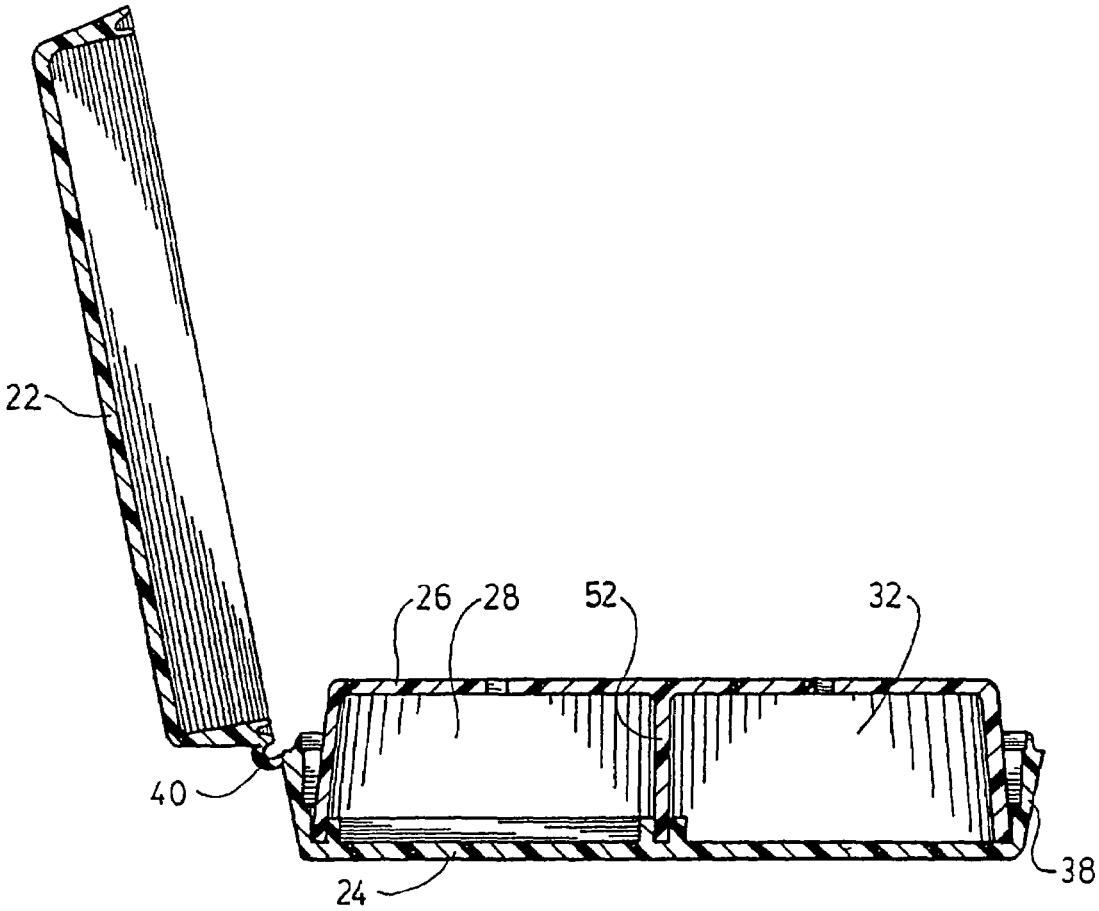
FIG. 10 is a cross section in open position.

FIG. 10 illustrates an embodiment in open position, of which the lid 22 is connected to the container 24 at a 125 degree angle and hinged around the hinge 40. The partition 52 appears in the inner box 26 to delimit, once it is put in contact with the low walls of the container 24, two chambers: the moist chamber 28 and the dry chamber 32. The male perimeter 38 around the container 24 is also shown in section. There may also be a single chamber.

Figure 11:
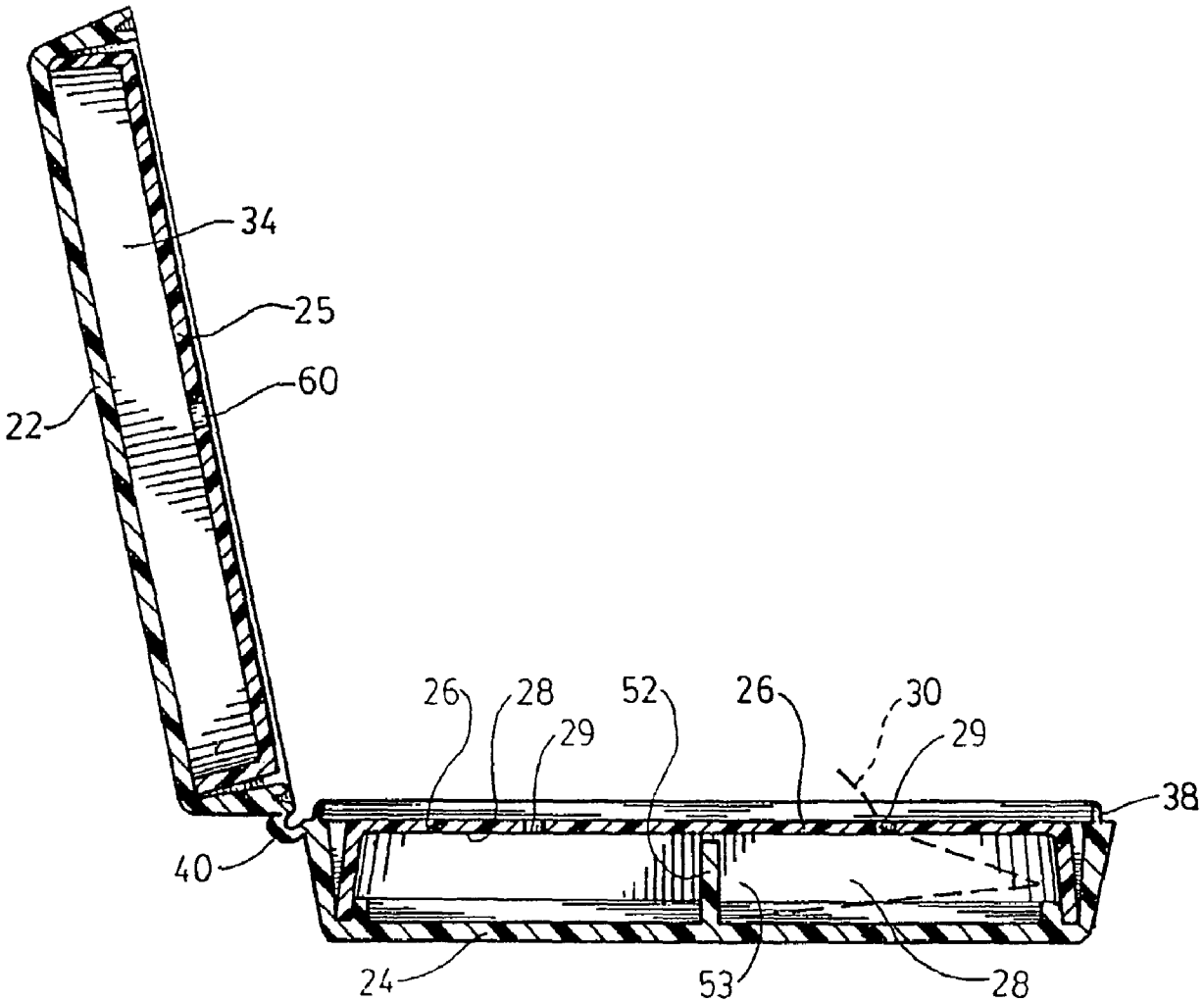
FIG. 11 is a cross section in open position illustrating three components.

FIG. 11 illustrates an embodiment which may use three compartments of which there are two moist chambers 28 made in a container compartment 53, by the partition 52 taken next to the bottom of the container 24. Two serrated outlet openings 29 for moist towelettes 30 are distanced from the partition 52 while the outlet for dry towelettes through the elongated opening 60 in the lid 22 is positioned centrally and opposite the partition 52 in order to remain away from the moist towelettes when the lid 22 is closed on the container 24.

SUMMARY OF THE INVENTION

In summary, the invention presents a dispenser 20 which comprises a container 24 and a lid 22 attached to the container. An inner box 26, which serves as a compartment which may be removable, is inverted in the container 24 and defines a compartment 27 for holding a stack of towelettes 30, the inner box 26 having a bottom 31 and a serrated opening 29 made in the bottom for removing the towelettes.

Due to a watertight means of attaching the container and the lid in a closed position, the opening of the lid around a hinge 40 and the passage of the towelettes through the serrated opening 29 make it possible to use towelettes kept in a controlled environment by pulling them.

A second box may be installed in the lid. This lid compartment 25 comprises a lid compartment opening for dispensing a second type of towelettes. The inner box and the lid compartment occupy, in a superposed position, a space which allows for a closed position of the lid.

The watertight means may be a rim of the lower part 38 which forms three male sides around the container 24 and a rim of the upper part which forms three females sides designed to cover the rim of the lower part. The hinge partly covers a fourth side. This fourth side comprises, in the rim of the lower part, a pair of short extensions of the male sides and, in the rim of the upper part, a thickening of the wall designed to fill in the short extensions.

The inner box 26 may also comprise a partition 52 which defines two chambers, one comprising a stack of towelettes of one type and the neighboring chamber comprising a stack of towelettes of a complementary type. Each chamber has an outlet opening to make it possible to remove the towelettes.

The reversible cartridge 62 (FIG. 9) has a lesser thickness than the thickness of the lid and may be placed on either side in the lid.

Other embodiments are possible: for example, the lid compartment 25 or the compartment 27 may or may not be removable. One method may involve the following steps:

construction of the lid compartment 25 and/or a compartment 27.

storage of the towelettes in those compartments.

followed by the sealing of those compartments by microwave heating.

The single or double cartridges of FIG. 2 or 8 may also be sealed. The same cartridges and containers may also be made with dimensions twice as large as those that currently appear.

A single chamber and a single opening may be found. The serrated opening may take the form of a corrugation and may be almost straight but with roughnesses that produce resistance and allow for retention. A straight but fairly narrow opening may also be used to create the necessary tension to separate the moist sheets so that they may be removed one by one.

It is well understood that the embodiment of this invention, which was described above, with reference to the attached drawing, was provided by way of example and is in no way restrictive, and that modifications and adaptations may be made without the object falling outside the framework of this invention.

Other embodiments are possible and are limited only by the scope of the claims that follow.

The invention claimed is:

1. A dispenser comprising: a container and a lid attached to said container; a removable inner box inverted in said container and defining a compartment for holding a stack of towelettes, said inner box having a bottom and a serrated opening made in said bottom for the removal of said towelettes, a watertight means of attaching said container and said lid in a closed position, the opening of said lid and the passage of said towelettes through said serrated opening making it possible to use towelettes kept in a controlled environment by pulling them, said removable inner box designed to make possible a single loading of said stacks of said towelettes and a means of sealing said removable inner box in place, the top of said inner box being sealed against the bottom of said container.

2. The dispenser (20) as claimed in claim 1 comprising a second box (25) in said lid (22), said second box (25) comprising an elongated opening (60) lid compartment (25) for dispensing a second type of towelettes (34), said inner box (26) and said second box (25) occupying, in a superposed position, a space allowing for a closed position of said lid.

3. The dispenser (20) as claimed in claim 2 of which said second box is removable.

4. The dispenser as claimed in claim 1 in which said means of sealing comprise the use of a microwave oven which makes possible the fusion of said top against said bottom.

5. The dispenser as claimed in claim 1 in which a reversible cartridge of a lesser thickness than the thickness of said lid is designed to be placed on either side in said lid.

6. A dispenser comprising: a container and a lid attached to said container; a removable inner box inverted in said container and defining a first compartment for holding a stack of moist towelettes and a second compartment for holding a stack of dry towelettes, said inner box having a bottom and a first opening made in said bottom for the removal of said moist towelettes and a second opening made in said bottom for the removal of said dry towelettes, a watertight means of attaching said container and said lid in a closed position, the opening of said lid and the passage of said towelettes through said first and second openings making it possible to use said towelettes kept in a controlled environment by pulling them through each said opening.

* * * * *